United States Patent [19]

Troxel

[11] Patent Number: 4,605,220

[45] Date of Patent: Aug. 12, 1986

[54] ANKLE EXERCISER

[75] Inventor: Tim L. Troxel, Kearney, Nebr.

[73] Assignee: Wikco Industries, Inc., Broken Bow, Nebr.

[21] Appl. No.: 722,648

[22] Filed: Apr. 12, 1985

[51] Int. Cl.[4] ..... A63B 23/04

[52] U.S. Cl. ..... 272/96; 272/130

[58] Field of Search ..... 272/130, 95, 97, 135, 272/146; 128/25

[56] References Cited

U.S. PATENT DOCUMENTS

| | | | |
|---|---|---|---|
| 478,166 | 7/1892 | Madsen | 272/96 |
| 1,613,538 | 1/1927 | Schad . | |
| 2,573,808 | 11/1951 | Ravoire | 272/57 |
| 2,707,465 | 5/1955 | Nemeth | 128/46 |
| 3,205,596 | 9/1965 | Hoffmeister | 36/7.8 |
| 3,511,500 | 5/1970 | Dunn | 272/79 |
| 3,587,319 | 6/1971 | Andrews | 272/130 |
| 4,186,920 | 2/1980 | Fiore et al. | 272/96 |
| 4,337,939 | 7/1982 | Hoyle et al. | 272/96 |

*Primary Examiner*—Richard J. Apley
*Assistant Examiner*—H. Macey
*Attorney, Agent, or Firm*—Zarley, McKee, Thomte, Voorhees & Sease

[57] ABSTRACT

An ankle exerciser for strengthening healthy ankles and for rehabilitating injured ankles. The exerciser includes a foot plate attached by a universal swivel joint to a support post. The universal swivel joint allows the foot plate to tilt or pivot about both longitudinal and transverse axes. Shock absorbers, having one end universally mounted to the foot plate, stabilize the foot plate, provide resistance to the pivotal movement, and limit the movement of the foot plate to the four basic directions of movement that are beneficial to strengthening the desired muscle groups. The exerciser makes it possible to successfully isolate the muscles involved in dorsiflexion, plantarflexion, inversion, and eversion while preventing tibial rotation of the foot.

11 Claims, 10 Drawing Figures

ANKLE EXERCISER

TECHNICAL FIELD

This invention relates to exercising devices and more particularly to devices to exercise the ankle.

BACKGROUND ART

Numerous exercising devices are currently available to strengthen and rehabilitate various muscle groups. Such known exercising devices are typically used for simultaneously conditioning a number of muscle groups by applying specific exercise routines. Few exercising devices for specific muscle groups are available.

It is known that ankle injuries can be minimized and victims of ankle injuries can be rehabilitated by exercise of specific muscle groups. Despite this knowledge, an exercising device designed specifically for the strengthening and rehabilitation of the ankle has not heretofore been provided.

Those concerned with these and other problems recognize the need for an improved ankle exerciser.

DISCLOSURE OF THE INVENTION

The present invention provides an ankle exerciser for strengthening healthy ankles and for rehabilitating injured ankles. The exerciser includes a foot plate attached by a universal swivel joint to a support post. The universal swivel joint allows the foot plate to tilt or pivot about both longitudinal and transverse axes. Shock absorbers, having one end universally mounted to the foot plate, stabilize the foot plate, provide resistance to the pivotal movement, and limit the movement of the foot plate to the four basic directions of movement that are beneficial to strengthening the desired muscle groups. The exerciser makes it possible to successfully isolate the muscles involved in dorsiflexion, plantarflexion, inversion, and eversion while preventing tibial rotation of the foot.

The foot is releasably secured to the foot plate by adjustable nylon straps having Velcro connectors. The resistance to pivotal movement of the foot plate can be adjusted by rotation of threaded adjustment rods that results in movement of the top of the shock absorber to adjust the distance between the top of the shock absorber and the universal pivot joint. Also, the height of the foot plate can be selectively adjusted by telescopic movement of the top post of the support post with respect to the tubular base post and securing the top post in position by engagement of set screws.

An object of the present invention is the provision of an improved ankle exerciser.

Another object is to provide an ankle exerciser that isolates the muscles involved in dorsiflexion, plantarflexion, inversion and eversion while preventing tibial rotation of the foot.

A further object of the invention is the provision of an ankle exerciser wherein the resistance of the device can be easily and quickly adjusted.

Still another object is to provide an ankle exerciser that is convenient to operate and easy to maintain.

A still further object of the present invention is the provision of an ankle exerciser that is versatile and adapted for use with both healthy and injured ankles.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
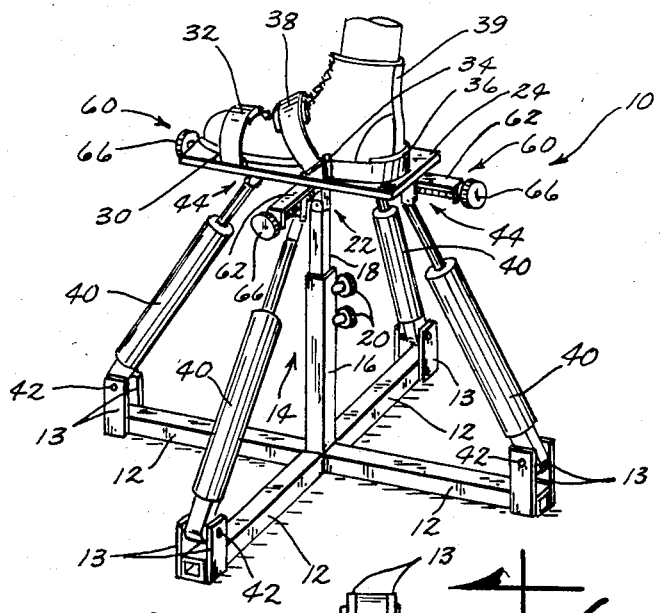
FIG. 1 is a perspective view of the ankle exerciser of the present invention illustrating the position of a human foot releasably secured to the foot plate.
Figure 2:
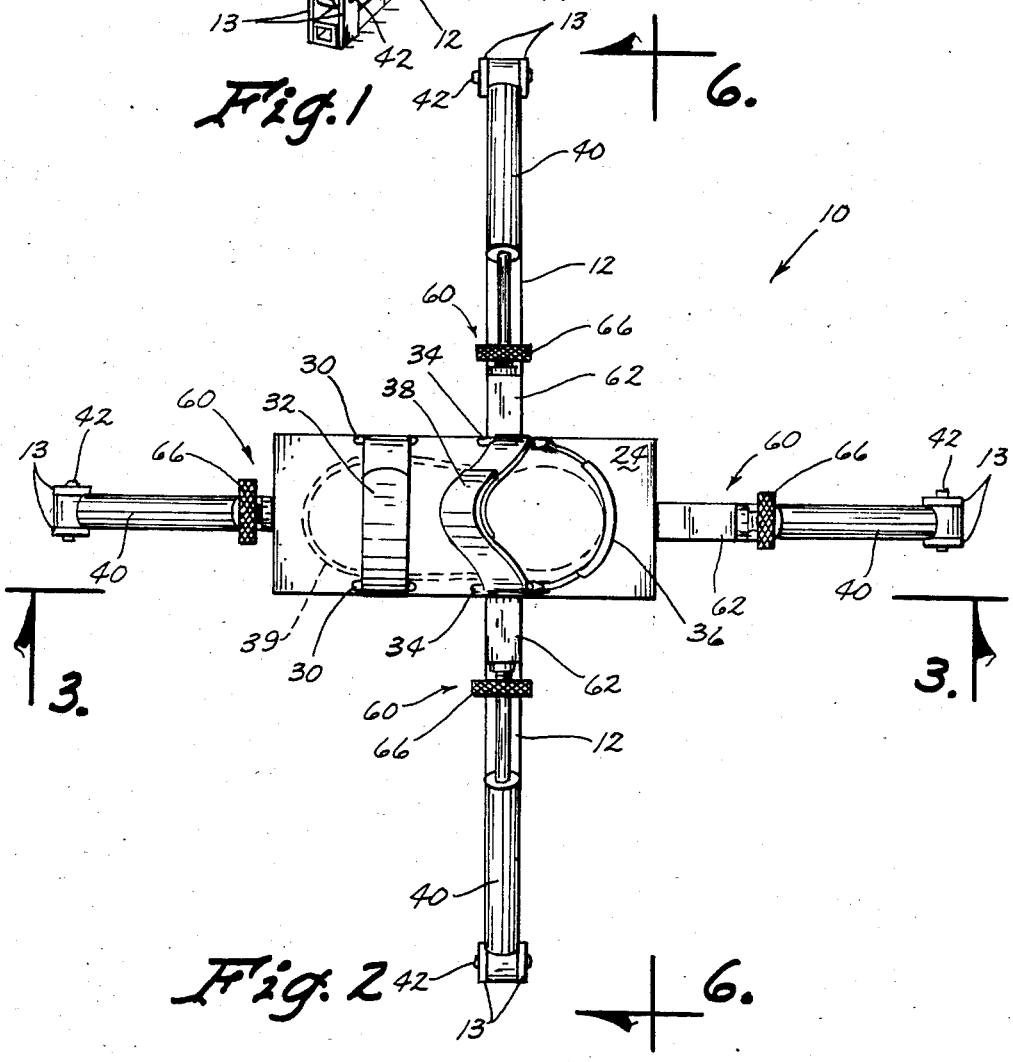
FIG. 2 is a top plan view thereof illustrating the position of the foot in dashed lines.

Referring now to the drawings, wherein like reference numerals designate identical or corresponding parts throughout the several views, FIG. 1 shows the ankle exerciser (10) of the present invention. The ankle exerciser (10) includes a base (12) and a support post (14) extending upwardly from the center of the base (12). The support post (14) has a tubular base post (16) and a top post (18) that is telescopically received therein and secured in the desired position by set screws (20). The upper end of the top post (18) includes a universal swivel joint (22) that is attached to and supports a foot plate (24). The universal swivel joint (22) allows the foot plate (24) to pivot about both a longitudinal axis and a transverse axis. The pivotal movement of the foot plate (24) about the longitudinal and transverse axes is resisted by shock absorbers (40).

The lower end of each shock absorber (40) is pivotally attached by pin (42) to an upwardly extending base yoke (13). The upper end of each shock absorber (40) is mounted for universal movement by swivel (44) to a force adjustment mechanism (60).

As most clearly shown in FIGS. 2, 3, 6 and 9, each force adjustment mechanism (60) includes a bracket (62)

attached to the underside of the foot plate (24). Each bracket (62) rotatedly receives a threaded adjustment rod (64) having an enlarged head (66). An adjustment nut (68) is carried on the rod (64). Rotation of the enlarged head (66) causes the nut (68) to travel along the rod (64) as indicated by the directional arrows in FIGS. 3 and 6. As the nut (68) is moved, the distance between the upper end of the shock absorber (40) and the universal swivel joint (22) is changed, thus changing the force required to pivot the foot plate (24).

Figure 3:
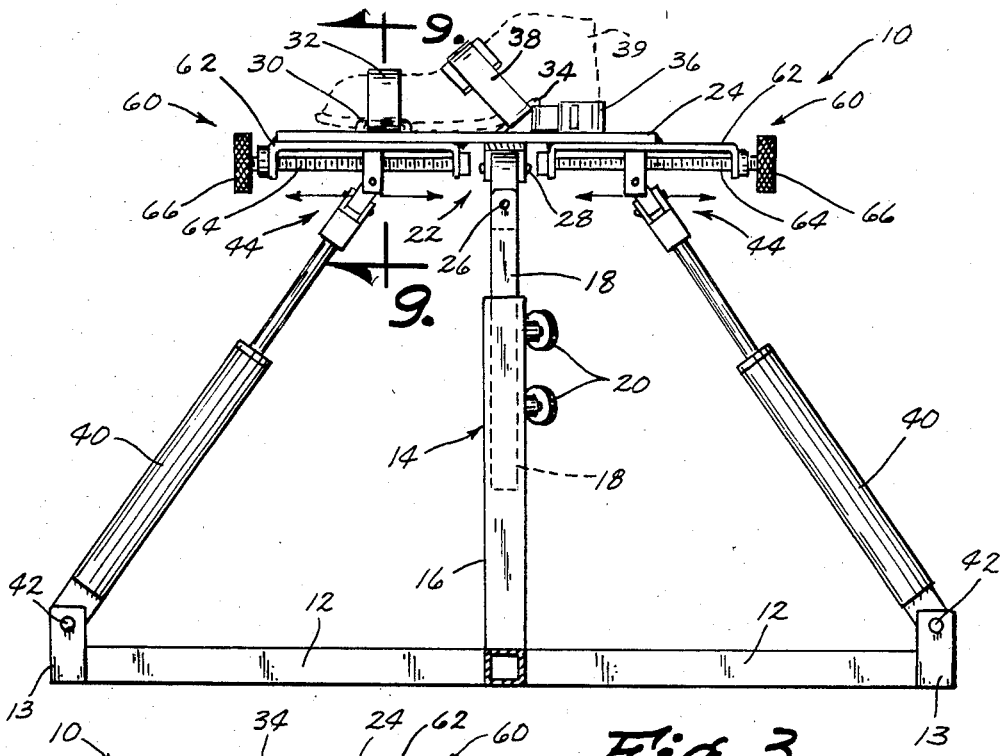
FIG. 3 is a side elevational view taken along line 3—3 of FIG. 2 illustrating the adjustable positioning of the upper ends of the shock absorbers along the length of the adjustment rods in a fore-and-aft direction.
Figure 4:
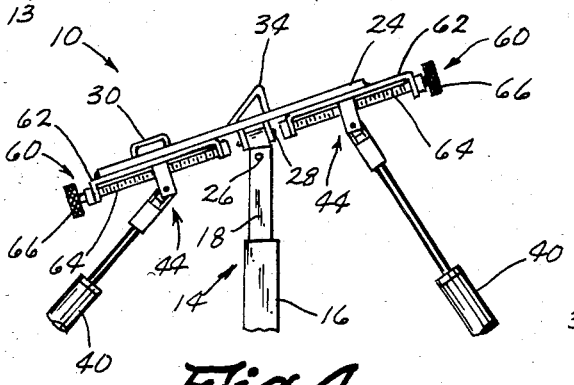
FIG. 4 is a reduced side elevational view similar to FIG. 3 but showing the foot plate moved to a forwardly inclined position, which movement isolates the muscles involved in plantarflexion.
Figure 9:
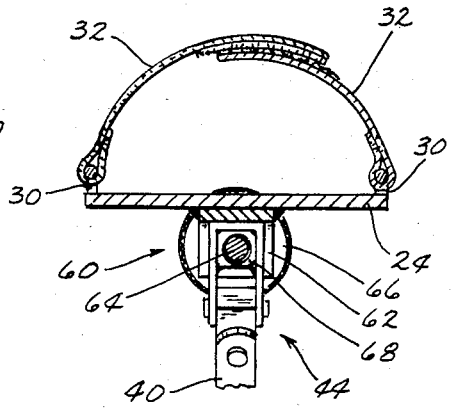
FIG. 9 is a rear elevation sectional view taken along line 9—9 of FIG. 3 illustrating the detail of the adjustment nut attached to the upper end of the shock absorber and showing the Velcro connection of the nylon toe straps.

Referring now to FIGS. 3, 4 and 9, the foot plate (24) includes a pair of upwardly extending loops (30) adapted to hold a pair of toe straps (32), and a pair of triangular loops (34) adapted to receive both an adjustable heel strap (36) and a pair of instep straps (38). The toe straps (32) and the instep straps (38) are adjustably attached by Velcro connectors.

Figure 5:
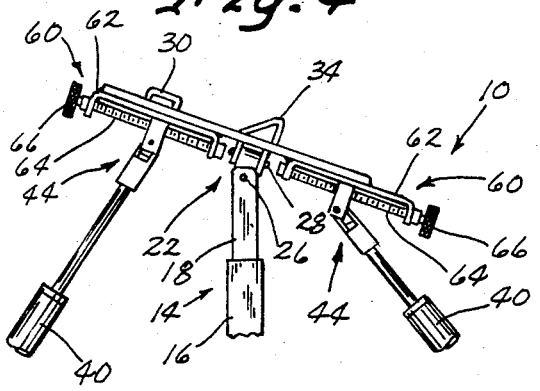
FIG. 5 is a side elevational view similar to FIG. 4 but showing the foot plate moved to a rearwardly inclined position, which movement isolates the muscles involved in dorsiflexion.
Figure 6:
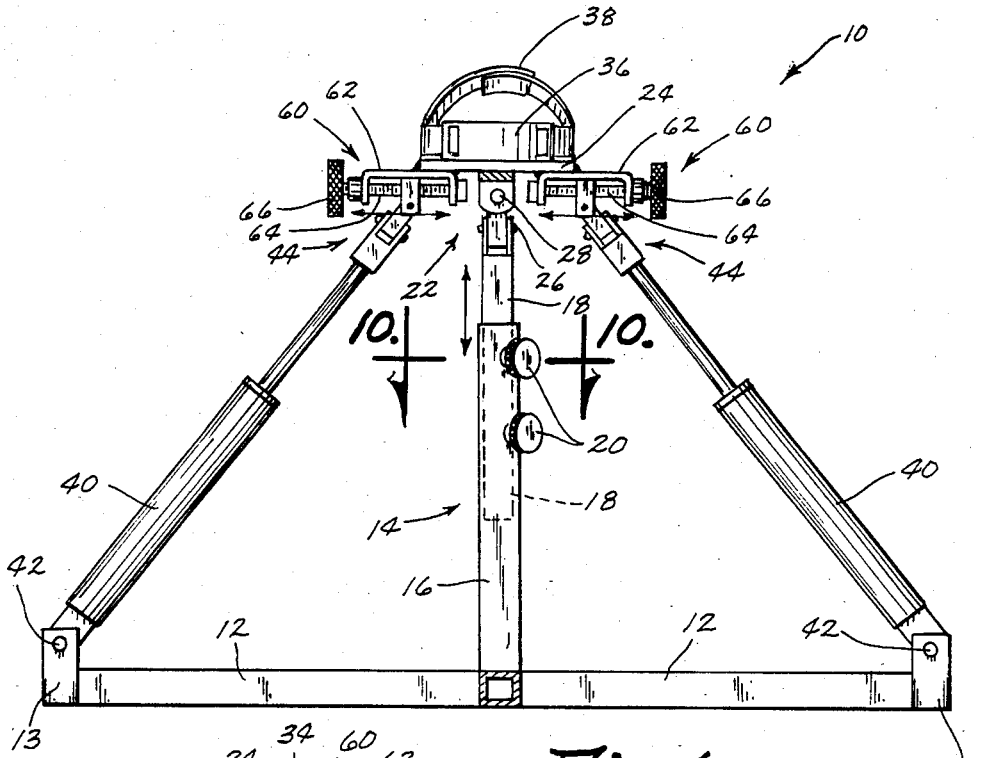
FIG. 6 is a rear elevational view taken along line 6—6 of FIG. 2 illustrating the adjustable positioning of the upper ends of the shock absorbers along the length of the adjustment rods in a transverse direction.
Figure 7:
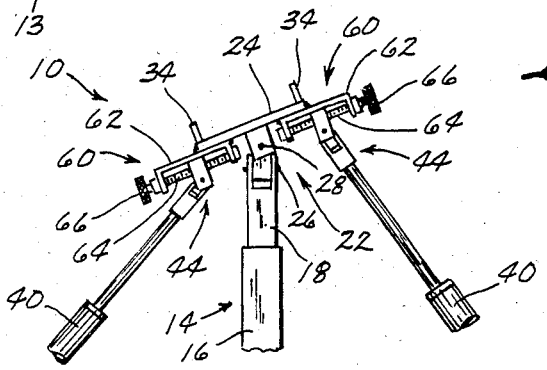
FIG. 7 is a reduced side elevational view similar to FIG. 6 but showing the foot plate moved to a transversely inclined position, which movement isolates the muscles involved in inversion and eversion of the left and right feet respectively.
Figure 10:
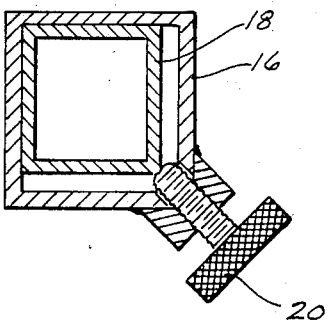
FIG. 10 is a top plan sectional view taken along line 10—10 of FIG. 6 illustrating the engagement of one of the set screws with the telescoping top post of the support post assembly.
Figure 8:
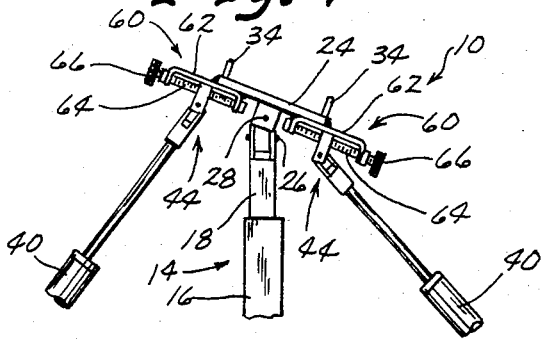
FIG. 8 is a side elevational view similar to FIG. 7 but showing the foot plate moved to a transversely inclined position opposite of the position illustrated in FIG. 7.

In operation, the length of the support post (14) is adjusted, the force adjustment mechanisms (60) are set, and the operator's foot (39) is positioned on and secured to the foot plate (24). Referring to FIGS. 3–5, pivoting of the foot plate (24) about the transverse axis defined by pin (26) of the universal swivel joint (22) is resisted by the fore-and-aft disposed shock absorbers (40). Since the pin (42) at the lower end of the fore-and-aft shock absorbers (40) is parallel to pin (26), the pivoting of the foot plate (24) about the transverse axis is limited to pivoting directly forward and to the rear. Referring now to FIGS. 6–8, pivoting of the foot plate (24) about the longitudinal axis defined by pin (28) of the universal swivel joint (22) is resisted by the laterally disposed shock absorbers (40). Since pin (42) at the lower end of the laterally disposed shock absorbers (40) is parallel to pin (28), the pivoting about the longitudinal axis is limited to pivoting directly to one side or the other. The structure of the ankle exerciser (10) provides for isolation of the muscles involved in dorsiflexion, plantarflexion, inversion and eversion, while preventing tibial rotation of the foot.

Thus, it can be seen that at least all of the stated objectives have been achieved.

Obviously, many modifications and variations of the present invention are possible in light of the above teachings. It is therefore to be understood that, within the scope of the appended claims, the invention may be practiced otherwise than as specifically described.

I claim:

1. An ankle exerciser, comprising:
   - a base;
   - a support post having one end attached to said base and having the other end attached to a universal swivel joint;
   - a foot plate attached to said universal swivel joint, said foot plate being pivotable about only a longitudinal axis and a transverse axis;
   - means connected to said foot plate for independently resisting pivotal movement of said foot plate only said longitudinal axis;
   - means connected to said foot plate for independently resisting pivotal movement of said foot plate only said transverse axis; and
   - means connected to said foot plate for releasably securing a human foot to said foot plate.

2. The ankle exerciser of claim 1, wherein the length of said support post is adjustable.

3. The ankle exerciser of claim 2 wherein said support post includes:
   - a tubular base post attached to said base;
   - a top post telescopically received within said base post; and
   - a set screw disposed to extend through said base post and selectively engage said top post, thereby providing for the adjustment of the length of said support post.

4. The ankle exerciser of claim 1, wherein said means for resisting the pivotal movement of said foot plate about said longitudinal axis includes:
   - a shock abosorber pivotally attached at one end to said base and universally mounted at the other end to said foot plate at a point along said transverse axis spaced from said universal swivel joint, said shock absorber being disposed such that it is pivotally attached to said base about an axis parallel to said longitudinal axis.

5. The ankle exerciser of claim 4 wherein each of a pair of shock absorbers interconnects said base and said foot plate, and wherein said shock absorbers are disposed on opposite sides of said universal swivel joint.

6. The ankle exerciser of claim 4 wherein said spacing from said universal swivel joint is adjustable.

7. The ankle exerciser of claim 6 wherein said foot plate includes:
   - a bracket attached to said foot plate;
   - a threaded adjustment rod carried by said bracket and disposed to extend along said transverse axis; and
   - an adjustment nut carried on said adjustment rod and attached to the other end of said shock absorber, wherein rotation of the adjustment rod causes the adjustment nut to move with respect thereto, thereby providing for the adjustment of the resistance to pivotal movement by adjusting the distance between the other end of the shock absorber and the universal swivel joint.

8. The ankle exerciser of claim 1, wherein said means for resisting the pivotal movement of said foot plate about said transverse axis includes:
   - a shock absorber pivotally attached at one end to said base and universally mounted at the other end to said foot plate at a point along said longitudinal axis spaced from said universal swivel joint, said shock absorber being disposed such that it is pivotally attached to said base about an axis parallel to said transverse axis.

9. The ankle exerciser of claim 8 wherein each of a pair of shock absorbers interconnects said base and said foot plate, and wherein said shock absorbers are disposed on opposite sides of said universal swivel joint.

10. The ankle exerciser of claim 8 wherein said spacing from said universal swivel joint is adjustable.

11. The ankle exerciser of claim 10 wherein said foot plate includes:
   - a bracket attached to said foot plate;
   - a threaded adjustment rod carried by said bracket and disposed to extend along said longitudinal axis; and
   - an adjustment nut carried on said adjustment rod and attached to the other end of said shock absorber, wherein rotation of the adjustment rod causes the adjustment nut to move with respect thereto, thereby providing for the adjustment of the resistance to pivotal movement by adjusting the distance between the other end of the shock absorber and the universal swivel joint.

* * * * *